US008864259B2

(12) United States Patent
Mitsuzawa

(10) Patent No.: US 8,864,259 B2
(45) Date of Patent: Oct. 21, 2014

(54) LIQUID EJECTING APPARATUS AND LIQUID EJECTING METHOD

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 157 days.

(21) Appl. No.: 13/439,436

(22) Filed: Apr. 4, 2012

(65) Prior Publication Data

US 2013/0093807 A1 Apr. 18, 2013

(30) Foreign Application Priority Data

Apr. 5, 2011 (JP) ..... 2011-083842

(51) Int. Cl.

| | |
|---|---|
| ***B41J 2/45*** | (2006.01) |
| ***B41J 2/47*** | (2006.01) |
| ***B41J 2/045*** | (2006.01) |
| ***B41J 11/00*** | (2006.01) |

(52) U.S. Cl.

CPC ..... *B41J 2/04541* (2013.01); *B41J 11/002* (2013.01)

USPC ..... 347/9; 347/102

(58) Field of Classification Search

CPC ..... B41J 2/45; B41J 2/47

See application file for complete search history.

(56) References Cited

U.S. PATENT DOCUMENTS

| | | | | |
|---|---|---|---|---|
| 5,971,518 | A | 10/1999 | Bolash et al. | |
| 6,874,864 | B1 * | 4/2005 | Maeda et al. | 347/41 |
| 7,607,773 | B2 | 10/2009 | Nagashima | |
| 7,690,749 | B2 | 4/2010 | Kachi | |
| 7,731,324 | B2 | 6/2010 | Nagashima | |
| 2001/0017647 | A1 * | 8/2001 | Kodama | 347/234 |
| 2003/0179262 | A1 * | 9/2003 | Nishikori et al. | 347/43 |
| 2005/0168509 | A1 * | 8/2005 | Yokoyama | 347/17 |
| 2007/0273720 | A1 * | 11/2007 | Yasutani et al. | 347/12 |
| 2008/0151029 | A1 * | 6/2008 | Yokoyama | 347/102 |
| 2009/0115827 | A1 | 5/2009 | Endo et al. | |
| 2009/0268240 | A1 * | 10/2009 | Watanabe et al. | 358/1.15 |

(Continued)

FOREIGN PATENT DOCUMENTS

| | | |
|---|---|---|
| CN | 1189414 | 8/1998 |
| CN | 101412316 | 4/2009 |

(Continued)

OTHER PUBLICATIONS

Mitsuzawa, JP2009-030321-2010184440—Machine Translation. pdf, Aug. 12, 2010.*

(Continued)

*Primary Examiner* — Geoffrey Mruk
*Assistant Examiner* — Scott A Richmond
(74) *Attorney, Agent, or Firm* — Workman Nydegger

(57) ABSTRACT

A liquid ejecting apparatus that includes a nozzle column configured to eject liquid cured by receiving irradiation of light, an irradiation section, and a controller that controls the nozzle column and the irradiation. The controller operates the liquid ejecting apparatus in a first print mode or a second print mode, the second print mode having an image quality lower than the first print mode. During the first print mode first dots are formed using a first nozzle region of the nozzle column and irradiated with light within a predetermined range. During the second print mode, second dots are formed using a second nozzle region of the nozzle column, the second nozzle region having a greater number of nozzles than that of the first nozzle region, and then irradiated with light within a range larger than the predetermined range.

6 Claims, 7 Drawing Sheets

(56) References Cited

U.S. PATENT DOCUMENTS

| | | | | |
|---|---|---|---|---|
| 2009/0309907 | A1* | 12/2009 | Kanda et al. | 347/9 |
| 2010/0201772 | A1* | 8/2010 | Mitsuzawa | 347/102 |
| 2013/0113867 | A1 | 5/2013 | Endo et al. | |

FOREIGN PATENT DOCUMENTS

| | | | |
|---|---|---|---|
| EP | 1849603 | | 10/2007 |
| JP | 2005-212366 | | 8/2005 |
| JP | 2005-313633 | | 11/2005 |
| JP | 2010184440 | A * | 8/2010 |
| WO | 2005-032827 | | 4/2005 |
| WO | 2007-148557 | | 12/2007 |

OTHER PUBLICATIONS

Extended European Search Report dated Jul. 3, 2012 for European Patent Application No. 12162960.4.

* cited by examiner

FIG. 8
| PRINT MODE | IMAGE QUALITY | PRINT SPEED | USING NOZZLE REGION |
|---|---|---|---|
| FIRST PRINT MODE | HIGH | SLOW | N1 |
| SECOND PRINT MODE | LOW | FAST | N2 |
FIG. 9
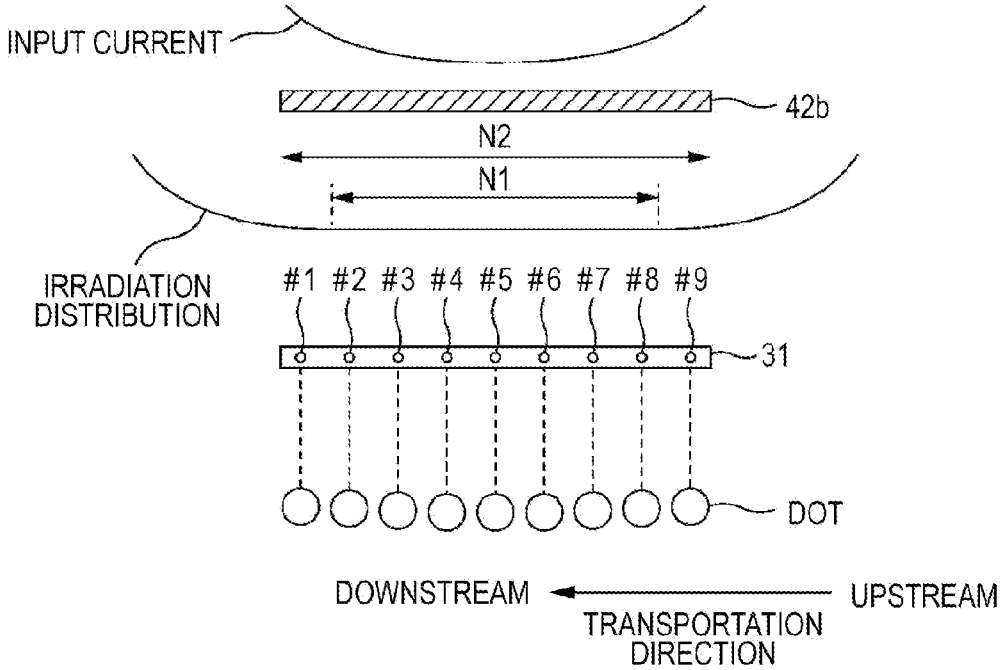
FIG. 10
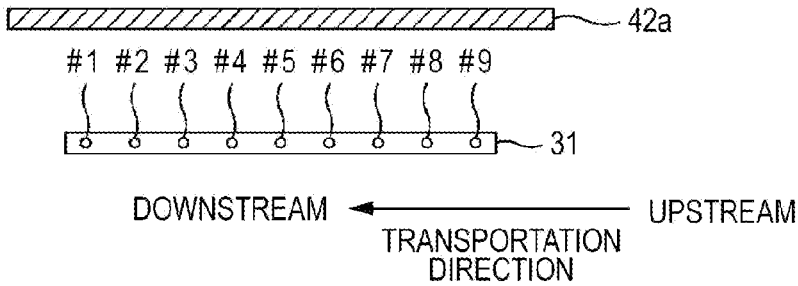

LIQUID EJECTING APPARATUS AND LIQUID EJECTING METHOD

BACKGROUND

1. Technical Field

The present invention relates to a liquid ejecting apparatus and a liquid ejecting method.

2. Related Art

A liquid ejecting apparatus is known (for example, JP-A-2005-212366) in which printing is performed using a liquid (for example, UV ink) cured by receiving irradiation of light (for example ultraviolet ray (UV)). Such a liquid ejecting apparatus includes an irradiation section irradiating light and irradiates the light from the irradiation section to dots formed on a medium after the liquid is ejected from nozzles to the medium. As described above, the dots are cured and fixed on the medium so that good printing can also be performed to the medium on which the liquid is difficult to be absorbed.

In the above described liquid ejecting apparatus, the irradiance distribution of the light is not constant according to the location. In this case, even though the amounts of the liquid ejected from the nozzles are the same as each other, variations occur in the size of dots formed on the medium. Thus, for example, when printing in a high image quality print mode, there is a concern that the dot diameter may vary and then the image quality may be decreased so that the printing may not be performed according to the print mode.

SUMMARY

An advantage of some aspects of the invention is that it provides a liquid ejecting apparatus and a liquid ejecting method to reliably perform printing according to the print mode.

According to an aspect of the invention, a liquid ejecting apparatus includes a nozzle column in which a plurality of nozzles ejecting liquid cured by receiving the irradiation of light is arranged in a predetermined direction; an irradiation section that is disposed along the predetermined direction corresponding to the nozzle column and irradiates light to dots formed on the medium by the nozzle column; and a controller that performs a first print mode or a second print mode having an image quality lower than that of the first print mode by performing control of ejecting of the liquid from the nozzle column, wherein at the time of the first print mode, the controller forms the dots using a first nozzle region of the nozzle column, where variation in the quantity of the light is within a predetermined range, the light being irradiated from the irradiation section to the dots formed by the nozzles of the first nozzle region, and wherein at the time of the second print mode, the controller forms the dots using a second nozzle region of the nozzle column, where the variation in the quantity of the light is within a range larger than the predetermined range, the light being irradiated from the irradiation section to the dots formed by the nozzles of the second nozzle region having a greater number of nozzles than that of the first nozzle region.

BRIEF DESCRIPTION OF THE DRAWINGS

The invention will be described with reference to the accompanying drawings, wherein like numbers reference like elements.

FIG. 8 is an explanatory view of relation between a print mode and a nozzle region used in the embodiment.

FIG. 9 is an explanatory view of irradiance distribution and a nozzle region used in a second embodiment.

FIG. 10 is an explanatory view of a modification example of a second embodiment.

DESCRIPTION OF EXEMPLARY EMBODIMENTS

Figure 1:
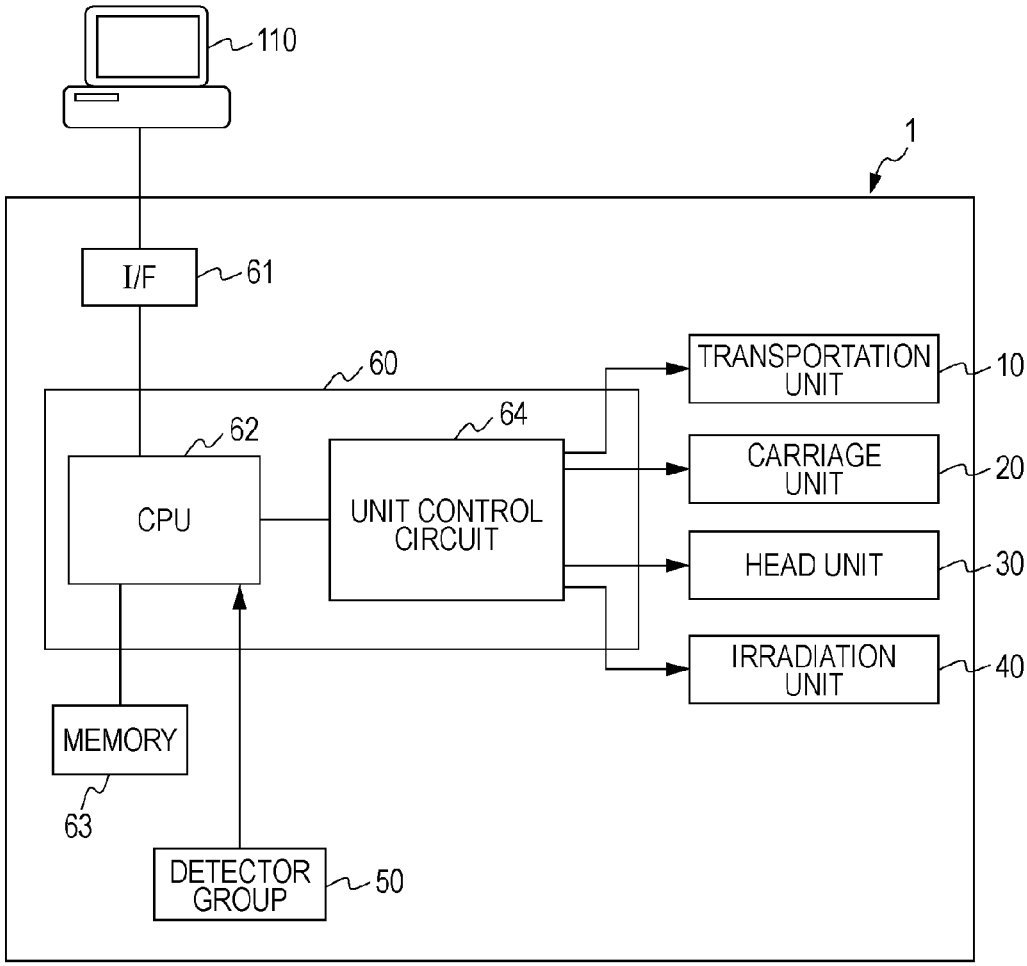
FIG. 1 is a block diagram illustrating a configuration of a printer.

The following items will be made clear through the specification and the annexed drawings.

It is clear that the liquid ejecting apparatus includes a nozzle column in which a plurality of nozzles ejecting liquid cured by receiving the irradiation of light is arranged in a predetermined direction; an irradiation section that is disposed along the predetermined direction corresponding to the nozzle column and irradiates the light to dots formed on the medium by the nozzle column; and a controller that performs a first print mode or a second print mode having an image quality lower than that of the first print mode by performing the control of ejecting of the liquid from the nozzle column, wherein at the time of the first print mode, the controller forms the dots using a first nozzle region of the nozzle column, where the variation in the quantity of the light is within a predetermined range, the light is irradiated from the irradiation section to the dots formed by the nozzles of the first nozzle region, wherein at the time of the second print mode, the controller forms the dots using a second nozzle region of the nozzle column, where the variation in the quantity of the light is within a range larger than the predetermined range, the light is irradiated from the irradiation section to the dots formed by the nozzles of the second nozzle region having a greater number of nozzles than that of the first nozzle region.

According to the liquid ejecting apparatus, in the first print mode, the high image quality printing can be performed in which the variation in the size of the dots is small, and in the second print mode, the number of nozzles used is large so that the printing can be performed quickly. As described above, the printing can be reliably performed according to the print modes.

It is preferable that the irradiation section has a plurality of LEDs arranged in the predetermined direction as a light source of the light, wherein the controller changes the input current into the plurality of LEDs according to a position in the predetermined direction.

According to the liquid ejecting apparatus, the range of the nozzle region can be widened.

It is preferable that with respect to a first LED of the plurality of LEDs and a second LED positioned further to end side thereof than the first LED in the predetermined direction, the controller allows the input current into the second LED to be larger than that into the first LED.

According to the liquid ejecting apparatus, the difference of the light quantity in each position in the predetermined direction can be decreased.

It is preferable that the intervals between adjacent LEDs in the predetermined direction are different according to the position in the predetermined direction.

According to the liquid ejecting apparatus, the range of the nozzle region can be widened.

It is preferable that the length of the irradiation section in the predetermined direction is longer than that of the nozzle column in the predetermined direction.

According to the liquid ejecting apparatus, the range of the nozzle region can be widened.

It is clear that a liquid ejecting apparatus includes a nozzle column in which a plurality of nozzles ejecting liquid cured by receiving the irradiation of light is arranged in a predetermined direction; an irradiation section that is disposed along the predetermined direction corresponding to the nozzle column and irradiates the light to dots formed on the medium by the nozzle column; and a controller that performs control of ejecting of the liquid from the nozzle column, wherein the controller changes the nozzle region used in the nozzle column according to an irradiance distribution of the light of a predetermined irradiation section in the predetermined direction, and print quality designated by a user.

It is clear that in a liquid ejecting method of a liquid ejecting apparatus having a nozzle column in which a plurality of nozzles ejecting liquid cured by receiving the irradiation of light is arranged in a predetermined direction, and an irradiation section that is disposed along the predetermined direction corresponding to the nozzle column and irradiates the light to dots formed on the medium by the nozzle column, the method includes a first print mode in which a plurality of dots is formed by ejecting the liquid from a first nozzle region of the nozzle column and the light where variation in light quantity is within a predetermined range, is irradiated from the irradiation section to each dot that is formed, a second print mode that has an image quality lower than that of the first print mode and in which a plurality of dots is formed by ejecting the liquid from a second nozzle region having the number of dots more than that of the first nozzle region, and the light where variation in light quantity is within a range that is larger than the predetermined range, is irradiated from the irradiation section to each dot that is formed.

In the embodiments below, an ink jet printer (hereinafter, also referred to as a printer 1) a liquid ejecting apparatus will be described as an example of the liquid ejecting apparatus.

First Embodiment

Configuration of Printer

Figure 2:
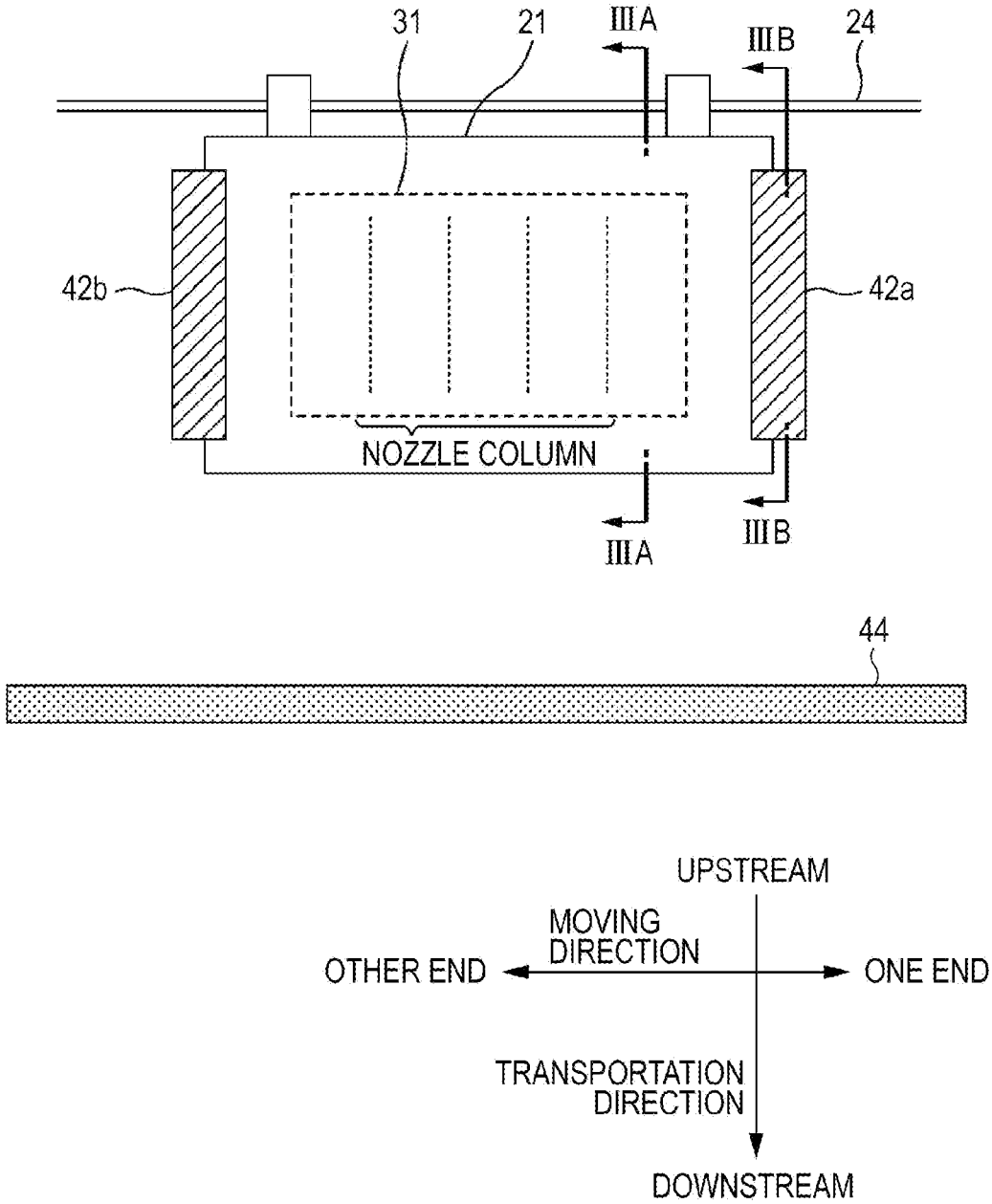
FIG. 2 is a schematic view of a periphery of a head of a printer.
Figure 3A:
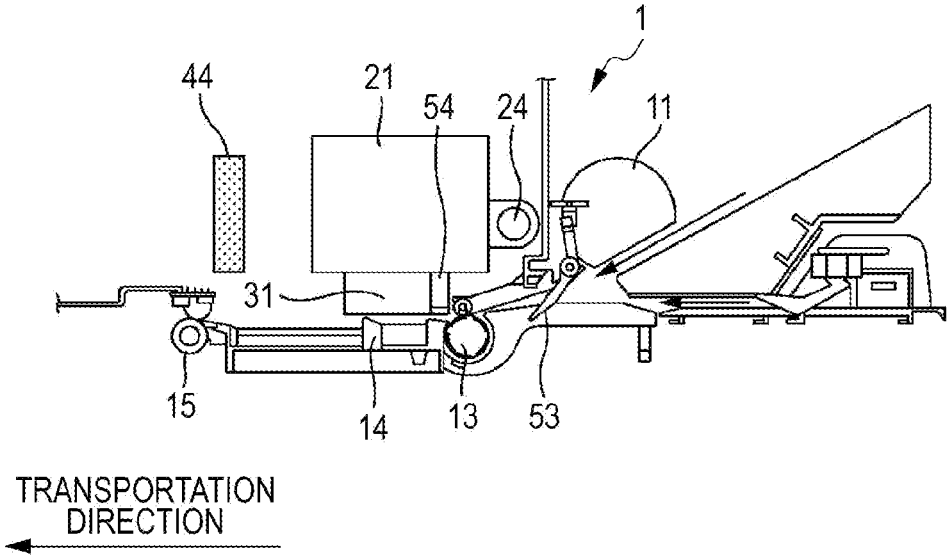
FIGS. 3A and 3B are cross-sectional views of a printer.
Figure 3B:
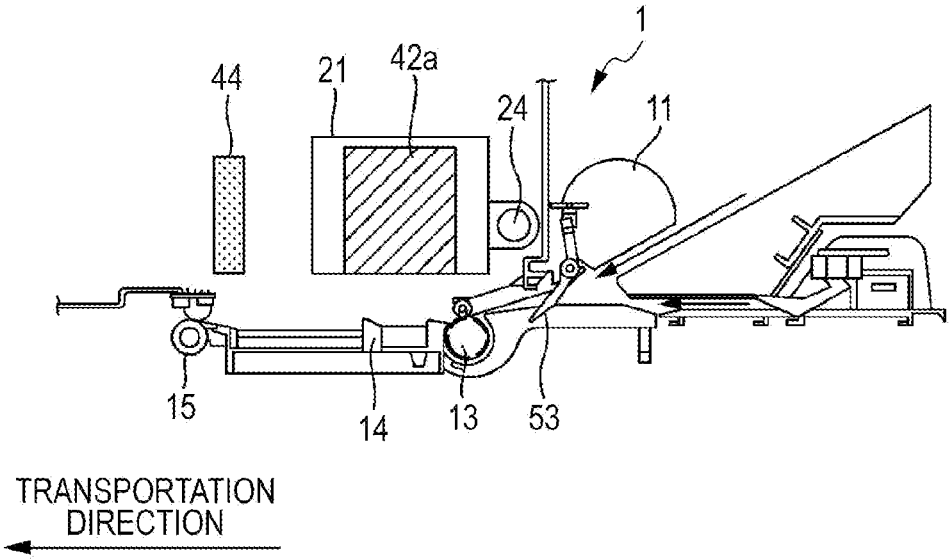

Hereinafter, a printer 1 of the embodiment will be described with reference to FIGS. 1, 2, 3A and 3B. FIG. 1 is a block diagram illustrating a configuration of the printer 1. FIG. 2 is a schematic view of a periphery of a head of the printer 1. FIGS. 3A and 3B are cross-sectional views of the printer 1. FIG. 3A is taken along IIIA-IIIA line in FIG. 2 and FIG. 3B is taken along IIIB-IIIB line in FIG. 2.

The printer 1 of the embodiment is an apparatus printing an image on the medium by ejecting the liquid to the medium such as paper, cloth, film sheet or the like. In the embodiment, as the liquid, ultraviolet ray curable type ink (hereinafter, also referred to as a UV ink) is used, which is cured by receiving the irradiation of the ultraviolet ray (hereinafter, also referred to as a UV) that is a type of light. The UV ink is an ink including an ultraviolet ray curable resin and is cured due to light polymerization reaction in the ultraviolet ray curable resin when receiving the irradiation of the UV. In addition, the printer 1 of the embodiment prints the image using four-color UV inks of CMYK.

The printer 1 has a transportation unit 10, a carriage unit 20, a head unit 30, an irradiation unit 40, a detector group 50 and a controller 60. The printer 1 receives print data from a computer 110 that is an external apparatus that performs control of each unit (the transportation unit 10, the carriage unit 20, the head unit 30 and the irradiation unit 40) with the controller 60. The controller 60 performs control of each unit and prints the image on the medium based on the print data received from the computer 110. A situation inside the printer 1 is monitored by the detector group 50 and the detector group 50 outputs the result of the detection to the controller 60. The controller 60 performs the control of each unit based on the result of the detection output from the detector group 50.

The transportation unit 10 is for transporting the medium (for example, the paper) in a predetermined direction (hereinafter, referred to as a transportation direction). The transportation unit 10 has a paper feeding roller 11, a transportation motor (not shown), a transportation roller 13, a platen 14 and a paper discharging roller 15. The paper feeding roller 11 is a roller for feeding the medium inserted in a paper inserting port into the printer. The transportation roller 13 is a roller transporting the medium that is fed by the paper feeding roller 11 to a printable region and is driven by a transportation motor. The platen 14 supports the medium that is in the printer. The paper discharging roller 15 is a roller discharging the medium outside the printer and is disposed at the downstream side with respect to the printable region in the transportation direction.

The carriage unit 20 moves (also referred to as "scanning") the head in the movement direction. In addition, the movement direction is a direction crossing the transportation direction. The carriage unit 20 has a carriage 21 and a carriage motor (not shown). In addition, the carriage 21 detachably holds the ink cartridge accommodating the UV ink. Thus, the carriage 21 reciprocates along the guide shaft 24 with the carriage motor in a supported state at the guide shaft 24 intersecting the transportation direction (described below).

The head unit 30 is for ejecting the liquid (the UV ink in the embodiment) on the medium. The head unit 30 includes a head 31 having a plurality of nozzles. Since the head 31 is disposed at the carriage 21, when the carriage 21 moves in the movement direction, the head 31 also moves in the movement direction. Thus, the UV ink is intermittently ejected when the head 31 moves in the movement direction so that a dot column (a raster line) is formed at the medium along the movement direction. In addition, in the embodiment, a route moving from one end to the other end in the movement direction in FIG. 2 is referred to as an outward trip and a route moving from the other end to one end is referred to as a return trip. In the embodiment, the UV ink is ejected from the head 31 at both the outward trip and the return trip. In other words, the printer 1 of the embodiment performs bi-directional printing.

In addition, the configuration of the head 31 will be described.

The irradiation unit 40 irradiates the UV to the UV ink on the medium. The dot formed on the medium cures through receiving irradiation of the UV from the irradiation unit 40. The irradiation unit 40 of the embodiment includes first irradiation sections 42*a* and 42*b*, and a second irradiation section 44. The first irradiation sections 42*a* and 42*b* are disposed at the carriage 21. Thus, when the carriage 21 moves in the movement direction, the first irradiation sections 42*a* and 42*b* also move in the movement direction.

The first irradiation sections 42*a* and 42*b* are disposed at one end and the other end of the head 31 respectively on the carriage 21 in the movement direction along the transportation direction so as to pinch the head 31. In the embodiment, the length of the first irradiation sections 42*a* and 42*b* in the transportation direction is substantially the same as the length of the nozzle column of the head 31. Thus, the first irradiation sections 42*a* and 42*b* move together with the head 31 to irradiate the UV in the range where the nozzle column of the head 31 forms the dot (provisional curing, described below). The first irradiation sections 42*a* and 42*b* of the embodiment include a light emitting diode (LED) as the UV light source. The LED controls the size of an input current so that irradiation energy of the UV can be easily changed.

In addition, in the embodiment, the first irradiation sections 42*a* and 42*b* are disposed at both ends of the carriage 21 in the movement direction. Thus, the irradiation section is converted, which irradiates the UV according to the outward trip and the return trip so that the UV can be irradiated at the dots just after the dots are formed at the medium by the head 31.

The second irradiation section 44 is disposed further to the downstream side in the transportation direction than the carriage 21. In other words, the second irradiation section 44 is disposed further to the downstream side in the transportation direction than the nozzle column of the head 31 and the first irradiation sections 42*a* and 42*b*. In addition, the length of the second irradiation section 44 in the movement direction is longer than the width of the medium that is to be the printing object. Thus, the second irradiation section 44 irradiates the UV to the medium transported below the second irradiation section 44 by the transportation operation (main curing, described below). The second irradiation section 44 of the embodiment includes a lamp (a metal halide lamp, mercury lamp or the like) as the light source irradiating the UV.

The detector group 50 includes a linear type encoder (not shown), a rotary type encoder (not shown), a paper detection sensor 53, the photosensor 54 or the like. The linear type encoder detects a position of the carriage 21 in the movement direction. The rotary type encoder detects an amount of the rotation of the transportation roller 13. The paper detection sensor 53 detects a position of a front end of the medium during feeding the paper. The photosensor 54 detects whether or not the medium is present by a light emitting section and a light receiving section attached at the carriage 21. Thus, the photosensor 54 detects the position of the end of the medium while moving by the carriage 21 and the width of the medium can be detected. In addition, the photosensor 54 can also detect the front end (that is the end to the downstream side in the transportation direction and also referred to as the upper end) and the rear end (that is the end to the upstream side in the transportation direction and also referred to as the lower end) of the medium according to the situation.

The controller 60 is a control unit (a control section) for performing the control of the printer 1. The controller 60 has an interface section 61, a CPU 62, a memory 63 and a unit control circuit 64. The interface section 61 performs transmitting and receiving of the data between the computer 110 that is the outside apparatus and the printer 1. The CPU 62 is an arithmetic processing unit for performing the control of the entire printer 1. The memory 63 is for reserving a region accommodating program of the CPU 62, a work region or the like, and has a storage element such as a RAM, an EEPROM, or the like. The CPU 62 performs the control of each unit via unit control circuit 64 according to the program accommodated in the memory 63.

When printing is performed, as described below, the controller 60 alternately repeats a dot formation operation ejecting the UV ink from the head 31 during moving in the outward trip direction and the return trip direction, and transportation operation transporting the medium in the transportation direction. The image configured of a plurality of dots is printed on the medium. In the description below, the dot formation operation is referred to as "a pass". In addition, $n^{th}$ pass is referred to as pass n. In the event of the pass, as described below, provisional curing is also performed.

Printing Procedure

The controller 60 performs process described below, to each unit of the printer 1 when printing the print data received from the computer 110. In addition, in the embodiment, as described above, the printing method (so-called bi-directional printing) is performed, in which dots are formed on the medium in both directions of the pass of the outward trip and the pass of the return trip.

First, the controller 60 rotates the paper feeding roller 11 and transports the medium to be printed (here, a paper S) as far as the transportation roller 13. Next, the controller 60 drives a transportation motor (not shown) so as to rotate the transportation roller 13. When the transportation roller 13 rotates by a predetermined amount of the rotation, the paper S is transported with a predetermined amount of the transportation.

When the paper S is transported to the lower portion of the head 31, the controller 60 rotates the carriage motor (not shown) in the predetermined direction (referred to as a forward direction). The carriage 21 moves in the movement direction (the outward trip direction) according to the rotation of the carriage motor. In addition, the carriage 21 moves so that the head 31 and the first irradiation sections 42*a* and 42*b* disposed at the carriage 21 also move in the movement direction (the outward trip direction) at the same time. Thus, during this period, the controller 60 allows the ink droplets to eject intermittently from the head 31. The ink droplets impact the paper S so that the dot column (the raster line) is formed where a plurality of dots is arranged in the movement direction. In addition, during the head 31 moves, the controller 60 allows the UV irradiation to perform from the first irradiation section 42*a* positioned the downstream side in the movement direction (the outward trip direction). Spreading of dots or bleeding between the dots formed during the pass of the outward trip is suppressed by the UV irradiation.

Next, the controller 60 allows the transportation motor to drive in the interval of the passes. The transportation motor generates the driving force in the rotation direction according to the amount of the driving instructed from the controller 60. Using the driving force, the transportation motor rotates the transportation roller 13. When the transportation roller 13 rotates by a predetermined amount of the rotation, the paper S is transported with the predetermined amount of the transportation.

After that, the controller 60 allows the carriage motor (not shown) to rotate in the reverse direction (a direction opposite to the forward direction). Accordingly, the carriage 21 moves in the movement direction (the return trip direction). In addition, the carriage 21 moves so that the head 31 and the first irradiation sections 42*a* and 42*b* disposed on the carriage 21 also move in the movement direction (the return trip direction) at the same time. Thus, during this period, the controller 60 causes the ink droplets to eject intermittently from the head 31. The ink droplets impact the paper S so that the dot column is formed where a plurality of dots is arranged in the movement direction. In addition, during the head 31 moves, the controller 60 allows the UV irradiation to perform from the first irradiation section 42*b* positioned at the downstream side in the movement direction (the return trip direction). Spreading of dots or bleeding between the dots formed during the pass of the outward trip is suppressed by the UV irradiation.

Furthermore, the controller 60 allows the transportation roller 13 to rotate in the interval of passes. When the transportation roller 13 rotates by the predetermined amount of the rotation, the paper S is transported with the predetermined amount of the transportation.

Hereinafter, similarly, the controller 60 alternately repeats the pass and the transportation of the paper S, and forms the dots to each pixel of the paper S.

Thus, the controller 60 allows the UV irradiation to perform from the second irradiation section 44 to the paper S when the paper S passes through below the second irradiation section 44 with the transportation operation. According to the UV irradiation, the dots on the paper S are fixed on the paper S with completely cured.

The paper S where the printing has been finished is discharged by the paper discharging roller 15 rotating synchronized with the transportation roller 13.

In this way, the image is printed on the paper S.

Configuration of Head 31

Figure 4:
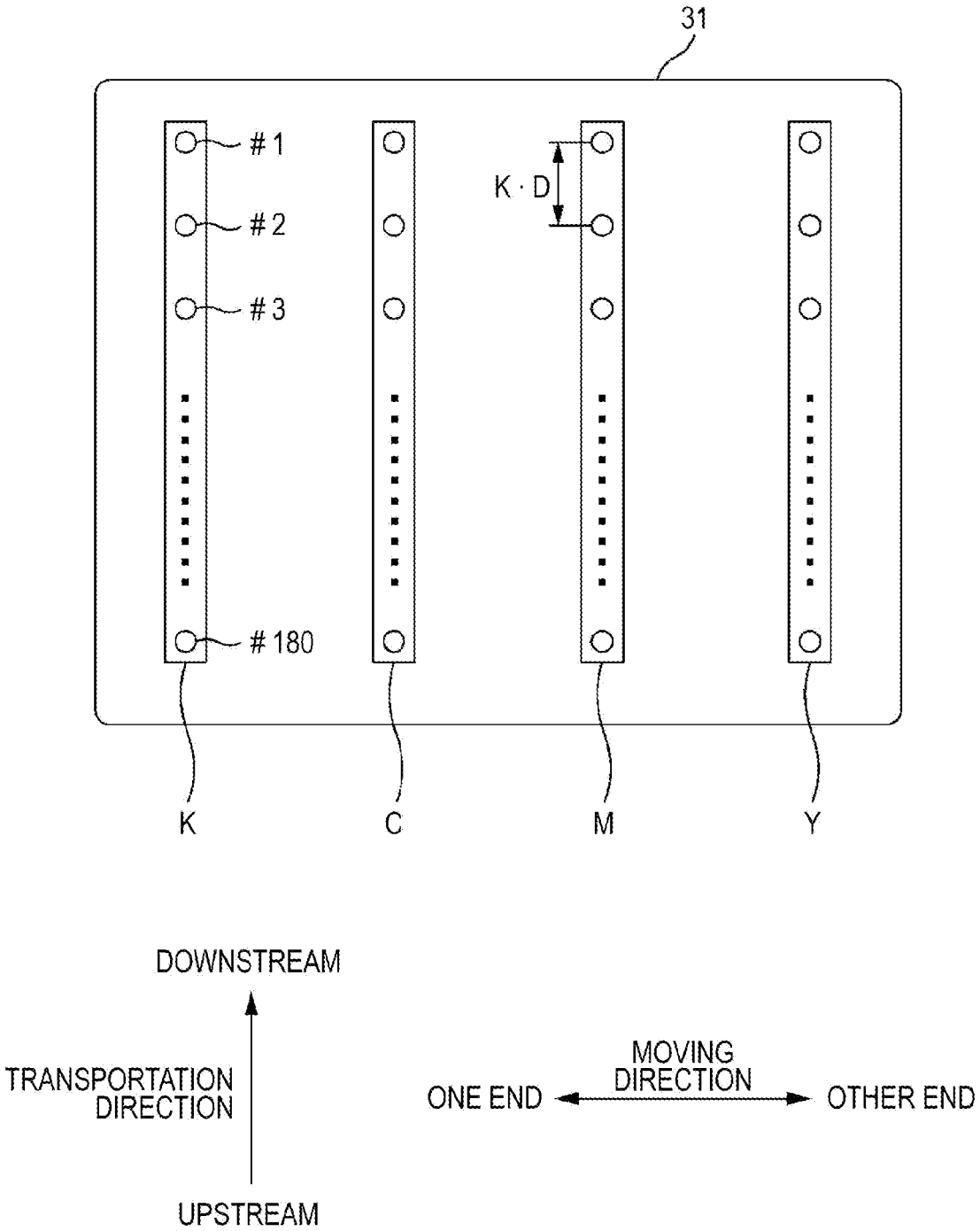
FIG. 4 is an explanatory view of a configuration of a head.

FIG. 4 is an explanatory view of an example of a configuration of the head 31. In addition, FIG. 4 is a view seen from above passing through the nozzles of the head 31. As shown in FIG. 4, a lower surface of the head 31 forms a black ink nozzle column K, a cyan ink nozzle column C, a magenta ink nozzle column M and a yellow ink nozzle column Y. Each nozzle column includes a plurality of nozzles (180 in the embodiment) which are ejecting ports for ejecting the UV ink of each color.

The plurality of nozzles of each nozzle column are arranged respectively with constant intervals (a nozzle pitch: k·D) along the transportation direction. Here, D is the minimum dot pitch (in other words, an interval in the highest resolution of the dots formed on the medium) in the transportation direction. In addition, k is an integer of 1 or more. For example, if the nozzle pitch is 180 dpi (1/180 inch) and the dot pitch in the transportation direction is 720 dpi (1/720 inch), k=4.

The nozzles of each nozzle column are affixed with numbers which descend to the downstream side in the transportation direction. A piezoelectric element (not shown) is disposed at each nozzle as a driving element for ejecting the UV ink from each nozzle. The piezoelectric element is driven by the driving signal so that the droplet-shaped UV ink is ejected from each nozzle. The ejected UV ink impacts the medium and forms the dots. Thus, the dots formed on the medium are cured by receiving the UV irradiation by the irradiation unit 40. In the embodiment, two-step curing of the provisional curing and the main curing is performed to cure the UV ink.

Provisional Curing and Main Curing

The provisional curing is the UV irradiation to suppress the flow (widening) of the dots or the spread between dots formed on the medium. Thus, the dot after the provisional curing is not completely cured, and the final dot shape is decided by the provisional curing.

Figure 5A:
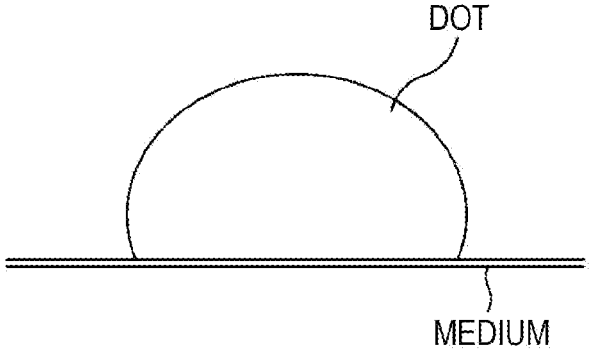
FIGS. 5A to 5C are explanatory views of a dot shape and irradiation intensity of UV.
Figure 5B:
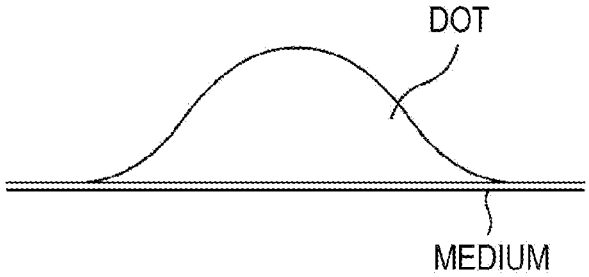
Figure 5C:
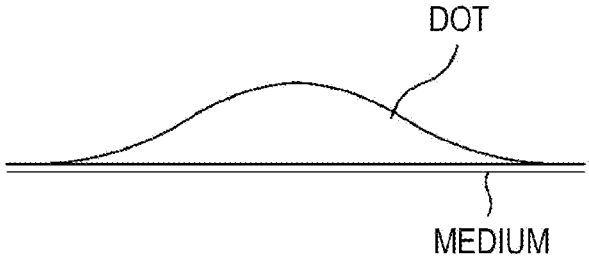

FIGS. 5A to 5C are explanatory views of the shape of the UV ink (dots) impacted on the medium and irradiation energy of the UV of the provisional curing. The irradiation energy of the UV in the provisional curing lowers in the order of FIG. 5A, FIG. 5B and FIG. 5C. In addition, timings of the UV irradiation (times from the formation of the dots to the UV irradiation) are the same as each other in each view.

If the irradiation energy of the UV is high at the time of the provisional curing, for example, as shown in FIG. 5A, the flow (spreading) of the dot becomes smaller. In other words, the dot diameter becomes smaller. In this case, it becomes image quality of low gloss where the gloss of the surface is suppressed. In addition, in this case, the bleeding hardly occurs between other inks.

Meanwhile, if the irradiation energy of the UV is low at the time of the provisional curing, for example, as shown in FIG. 5C, the flow (widening) of the dot increases. In other words, the dot diameter becomes larger. In this case, it becomes image quality of high gloss where the gloss of the surface is increased. In addition, in this case, the bleeding easily occurs between other inks.

The main curing is the UV irradiation for completely curing the ink. On this account, as the light source of the second irradiation section 44, a light source (for example, lamp or the like) irradiating the UV having the energy stronger than that of the first irradiation sections 42*a* and 42*b* is used.

Relation between Irradiance Distribution and Nozzle Column

Next, relation between the irradiance distribution of the first irradiation sections 42*a* and 42*b* and the nozzle column of the head 31 will be described. In addition, the first irradiation section 42*a* and the first irradiation section 42*b* have the same configuration. Accordingly, description will be made using only one (the first irradiation section 42*a* in the embodiment) thereof. In addition, there are four nozzle columns in the head 31, and description will be made using only one (for example, the black nozzle column) thereof.

Figure 6:
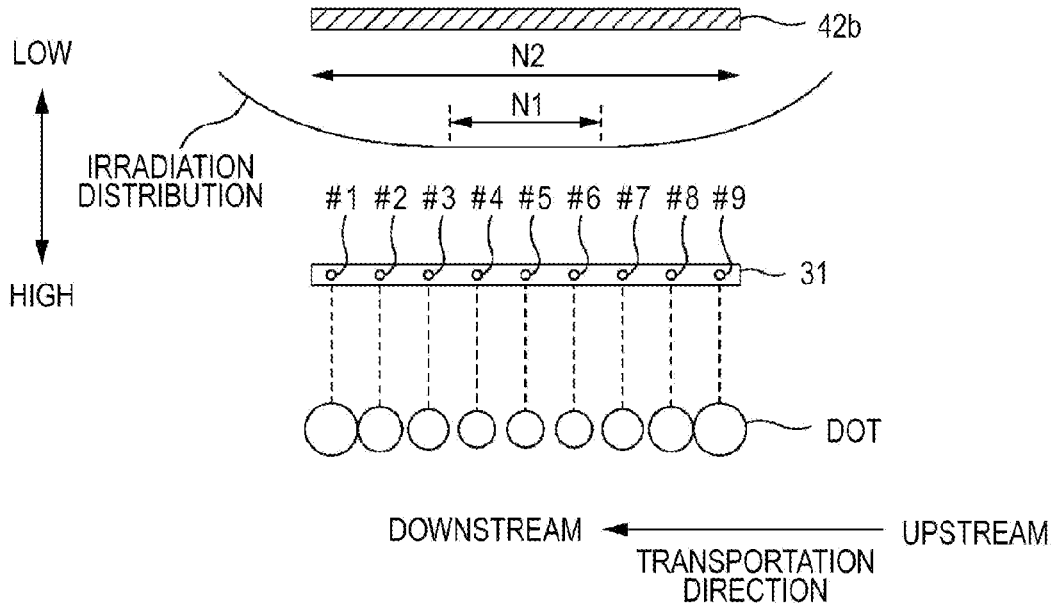
FIG. 6 is a conceptual view explaining relation between an irradiance distribution and a nozzle column in a first embodiment.

FIG. 6 is a conceptual view explaining the relationship between the irradiance distribution and the nozzle column in the first embodiment. In the same view, the first irradiation section 42*a*, the nozzle column (for example, the black nozzle column) of the head 31 and the image of the dots formed by the nozzle column are shown.

In addition, for simplicity of description, nine nozzles (#1 to #9) are used in the nozzle column of the head 31. Thus, the length of the first irradiation section 42*a* corresponds to nine nozzle columns of the head 31.

The first irradiation section 42*a* is disposed at a position (a position that is arranged in the movement direction) corresponding to the nozzle column of the head 31 in the carriage 21. Thus, the first irradiation section 42*a* irradiates the UV for the provisional curing to the dots formed by the nozzle column of the head 31 when the carriage 21 moves in the outward trip direction (one end to the other end of the movement direction). Here, the UV ink is ejected from each nozzle of the shown nozzle column with the same conditions as each other (the amount of the ejecting of the ink or the like). In other words, the sizes of the dots (the dot before receiving the UV irradiation) just after formation on the medium are the same as each other. The dots are provisionally cured by receiving the UV irradiation from the first irradiation section 42*a*.

Here, in the view, a curve shown below of the first irradiation section 42*a* illustrates the irradiance distribution of the first irradiation section 42*a*. The irradiance distribution conceptually illustrates the amount of the irradiation (the light quantity) of the UV from the first irradiation section 42*a*, and the lower the upper side and the higher the lower side in the view. As shown in the view, the irradiance is high and stable at the vicinity of the center of the first irradiation section 42*a* however, the irradiance is low while approaching the end of the first irradiation section 42*a*. Thus, the variation in the light quantity becomes larger in a case where the UV is irradiated to each dot formed at the region (the nozzle region N1) including the end compared to a case where the UV is irradiated to each dot formed at the region (the nozzle region N2) of only center portion. The reason thereof will be described with reference to FIG. 7.

Figure 7:
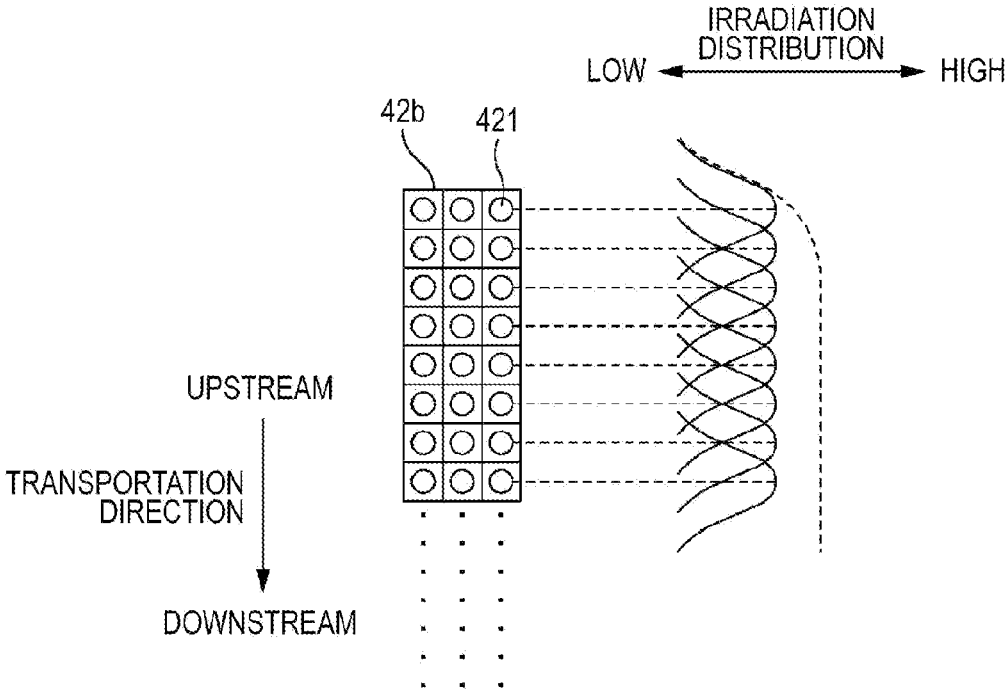
FIG. 7 is a conceptual view explaining irradiance distribution of a first irradiation section.

FIG. 7 is a conceptual view explaining the irradiance distribution of the first irradiation section 42*a*. As shown in left side in FIG. 7, as the light source irradiating the UV, the LEDs 421 are disposed in plurality at the first irradiation section 42*a*. In addition, in the view, the LEDs 421 are disposed in plurality in the vertical direction (the transportation direction) and the horizontal direction (the movement direction) respectively, however, the LEDs 421 may be disposed in plurality at least along the vertical direction (the transportation direction). Thus, the UV can be irradiated to each unit formed by the nozzle column of the head 31.

The right side of FIG. 7 illustrates the irradiance distribution of the first irradiation section 42*a*. In the view, solid lines illustrate the irradiance distribution of the LEDs 421 arranged in the transportation direction respectively and a broken line illustrates the irradiance distribution of the first irradiation section 42*a*.

As shown in the solid line in the view, the irradiance of individual LEDs 421 becomes the maximum (the peak) at the center thereof and the irradiance decreases in a curve as parting from the center thereof. When overlapping the irradiance distribution of the UV by each LED 421, the irradiance distribution becomes as the broken line in the view. In other words, the irradiance is high and the variation thereof is small in the vicinity of the center thereof in the transportation direction, however approaching the end there of in the transport direction, the illuminance decreases and thereby the variation becomes large. Accordingly, the irradiance distribution of the UV of the first irradiation section 42*a* becomes the distribution shape as shown in FIG. 6.

Since the irradiance distribution of the first irradiation section is the distribution shape as described above, when the formation of the dot is performed by each nozzle of the nozzle column of the head 31 under the same condition as each other, the sizes are the same as each other just after the dots are formed. However, the variation occurs in the size of the dots after the UV irradiation as shown in FIG. 6. Specifically, the dot sizes are substantially the same as each other at the vicinity (the vicinity of nozzles #4 to #6) of the center thereof in the transportation direction where the variation in the irradiance is small, however, the dot size becomes large approaching the end thereof in the transportation direction. Thus, if the image of the high image quality is printed, it is difficult to evenly control the size of the dot and the desired image quality cannot be obtained. Thus, in the embodiment, the using region of the nozzle column is to be varied according to the print mode and the irradiance distribution.

Relation between Print Mode and Using Nozzle

FIG. 8 is an explanatory view of a relation between the print mode and the nozzle region used in the embodiment.

As shown in the view, in the embodiment, as the print mode, two print modes of the first print mode and the second print mode can be performed. In addition, the print mode is selected (designated) by a user with the user interface or the like that is displayed on the screen (not shown) of the computer 110 for example, at the time of printing.

The first print mode is a mode (a clean mode) performing the high image quality printing. In this case, since it is desired that the dot diameter be reliably controlled, the nozzle region N1 (nozzle #4 to nozzle #6 in FIG. 6) is selected as the nozzle region used. Accordingly, the dot diameter can be reliably controlled and the high image quality printing can be performed. However, since the region of the using nozzle is narrow and then the number of the passes that is performed with respect to the print region increases, the printing speed is slow.

Meanwhile, the second print mode is a mode (a fast mode) performing the printing at high speed. In this case, the nozzle region N2 (nozzle #1 to nozzle #9 in FIG. 6) is selected as the nozzle region used. Since the number of the nozzles used increases, the number of the raster lines that can be formed in one pass increases. Accordingly, the number of the passes that is performed with respect to the print region decreases and the printing can be performed at high speed. However, as described above, since the variation in the dot diameter increases at the nozzle region N1, the image quality decreases compared to the first print mode.

The controller 60 converts the nozzle region of the nozzle column to the nozzle region N1 or the nozzle region N2, wherein the nozzle column is used when printing is performed according to the print mode designated by the user and the irradiance distribution of the first irradiation section 42*a* shown in FIG. 6. By doing this, the printing can be reliably performed according to the print modes. For example, in the first print mode, since the number of the using nozzle is reduced, the printing speed decreases, and the variation in the dots is small and the image of further high image quality can be printed. Meanwhile, in the second print mode, since the size of the dots is varied, the image quality is lowered, however, since many nozzles can be used, the printing can be performed at higher speeds.

In addition, in the embodiment, the print modes are two, however the invention is not limited to the embodiment and it may be in plurality. For example, the print modes may also be three. Even in this case, the nozzle region used of the nozzle column may be changed according to the print modes (the image quality or the like) and the irradiance distribution.

As described above, at the time of the first print mode, the printer 1 of the embodiment forms the dots using the nozzle region N1 wherein the number of the nozzles is small in the nozzle columns of the head 31 and the variation in the quantity of the light irradiated to the formed dots is small. In addition, at the time of the second print mode, the dots are formed using the nozzle region N2 wherein the number of the nozzles is more than the number of the nozzle region N1 and the variation in the quantity of the light irradiated to the formed dots is large. By doing this, in the first print mode, the printing is performed at high speed and in the second print mode, the printing is performed at high image quality. As described above, the printing can be reliably performed according to the print modes.

Second Embodiment

In the first embodiment, the range of the nozzle region N1 used in the first print mode has been narrow (for three nozzles). Thus, there is a concern that the print time may be slow considerably. Accordingly, the second embodiment is planning to expand the range of the nozzle region N1. In the second embodiment, the configuration and the operation of the printer 1 is similar to that of the first embodiment so that the description thereof is omitted.

FIG. 9 is an explanatory view of the irradiance distribution and the nozzle region used in a second embodiment. In addition, the viewpoint of the view is similar to that of the first embodiment (FIG. 6). However, in FIG. 9, an input current into each LED 421 of the first irradiation section 42*a* is illustrated. In addition, the value of the input current illustrating in the view is larger as upper and smaller as lower in the view. For example, the input current at the end of the nozzle column is larger than that at the center of the nozzle column.

The input current into the LEDs 421 is the same as each other (the irradiation energy of the UV of each LED 421 are the same as each other) in the first embodiment, regardless the position in the transportation direction. Meanwhile, in the printer 1 of the second embodiment, the input current into each LED 421 of the first irradiation section 42*a* is changed according to the position of the transportation direction. In other words, as shown in the view, the input current is to be gradually increased approaching the ends (the upstream end and the downstream end) in the transportation direction.

Accordingly, the irradiance distribution of the UV is different from the case of the first embodiment. Specifically, in the first embodiment, the nozzle region N1 is in the range of the nozzles #4 to #6, while when the nozzle region N1 is set in the variation range of the same irradiance distribution, the range of the nozzles #2 to #8 can be set. As described above, the input current of the LED changes according to the position in the transportation direction so that the nozzle region can be widened.

As described above, in the second embodiment, the input current of each LED of the first irradiation section 42*a* can be changed according to the position in the transportation direction. Accordingly, the range (the nozzle region N1) using in the nozzle column can be widened. In addition, in the embodiment, the range of only the nozzle region N1 is widened and similarly, the input current into the LEDs 421 is controlled so that the nozzle region N2 can also be widened.

Modification Example of Second Embodiment

In the above described embodiment, the range of the nozzle region N1 is widened by changing the input current into the LEDs 421 arranged in the transportation direction according to the position of the transportation direction, however, in the modified example, the range of the nozzle region N1 can be widened without change the input current of the LEDs 421.

FIG. 10 is an explanatory view of the modification example of the second embodiment. As shown in the view, the length of the first irradiation section 42*a* is longer than the length of the nozzle column. Accordingly, the nozzle region N1 can be set wider than that of the first embodiment within the variation range of the same irradiance distribution.

In addition, the interval between the LEDs 421 adjacent to each other may be arranged with changing the interval according to the position in the transportation direction. Specifically, the interval in the center portion in the transportation direction may be wider than the interval in the end thereof. By doing this, the difference of the irradiance between the center portion and the end thereof can be decreased and the nozzle region N1 can be widened.

Other Embodiments

The printer or the like has been described as one of embodiments, however, the above described embodiments are for easily understanding the invention and are not to be constructed as limiting the invention. The invention can be modified and improved without departing from its spirit thereof and it is understood that equivalents thereof are also included in the invention. Specifically, embodiments described below are also included in the invention.

Printer

In the above described embodiments, a printer has been described as an example of the apparatus, the invention is not limited to the embodiments. For example, the same technology as the embodiments may be applied to various liquid ejecting apparatus that applies ink jet technology such as a color filter manufacturing apparatus, a dyeing apparatus, a fine processing apparatus, a semiconductor manufacturing apparatus, a surface processing apparatus, a three-dimensional molding machine, a liquid vaporizer, an organic EL manufacturing apparatus (specifically, polymer EL manufacturing apparatus), a display manufacturing apparatus, a film formation apparatus, a DNA chip manufacturing apparatus or the like.

In addition, the embodiment is the serial type printer, however, the invention is not limited to the embodiment, and for example, may be applied to a lateral type printer.

Head

In the above described embodiments, one head 31 is disposed on the carriage 21, however, the invention is not limited to the embodiment, and a plurality of heads 31 may be disposed on the carriage 21. In this case, the first irradiation sections 42*a* and 42*b* may be disposed so as to irradiate the UV at the dot formation range according to each nozzle column of a plurality of the heads 31.

Nozzle

In the above described embodiments, the ink has been ejected using the piezoelectric element (the piezo element). However, the method of ejecting the liquid is not limited to the embodiments. For example, other methods may be used such as a method of generating bubbles inside the nozzle by heat or the like.

Ink

In the above described embodiments, the ink (the UV ink) that is cured by receiving the irradiation of the ultraviolet ray (UV) has been ejected from the nozzle. However, the liquid ejecting from the nozzle is not limited to the above described ink, ink that is cured by receiving the irradiation of other light (for example, visible ray, or the like) except the UV may be ejected from the nozzle. In this case, the light (for example, visible light or the like) for curing the liquid may be irradiated from each irradiation section.

Irradiation Section

In the above described embodiments, the first irradiation section 42*a* and the first irradiation section 42*b* are disposed at both ends of the carriage 21 in the movement direction respectively, however, it may be disposed on one of either. In addition, for example, if the printing is performed in a single direction, when the first irradiation section is disposed at the downstream side of the head 31 in the movement direction in the pass that forms the dot, the UV irradiation for the provisional curing can be performed just after the dot formation.

In addition, in the above described embodiments, the UV irradiation for the main curing is performed after the provisional curing with disposing the second irradiation section 44, however, the main curing may be performed with the first irradiation sections 42*a* and 42*b*. For example, the printing is performed in a single direction and the UV is irradiated (in other words, the UV irradiation for the provisional curing is performed twice) from the first irradiation sections 42*a* and 42*b* when the carriage 21 reciprocates, the dots may be completely cured. Otherwise, the UV irradiation energy of each of the first irradiation sections 42*a* and 42*b* is strengthened so that the dots may be completely cured at one time with UV irradiation. In addition, in a case where the dots are completely cured by the above described first irradiation sections 42*a* and 42*b*, the second irradiation section 44 may not be disposed.

The entire disclosure of Japanese Patent Application No. 2011-083842, filed Apr. 5, 2011 is expressly incorporated by reference herein.

What is claimed is:

1. A liquid ejecting apparatus comprising:

a nozzle column in which a plurality of nozzles configured to eject a liquid cured by receiving an irradiation of light is arranged in a predetermined direction parallel to a transportation direction of a medium, the nozzle column including a first region having a plurality of the plurality of nozzles and a second region having another plurality of the plurality of nozzles that incorporates the first region;

an irradiation section disposed along the predetermined direction corresponding to the nozzle column and configured to irradiate the light to dots formed on the medium by the nozzle column, the irradiation section including a third region corresponding to the first region and a fourth region corresponding to the second region, where a variation in a quantity of the light irradiated from the third region of the irradiation section is within a predetermined range and where a variation in a quantity of the light irradiated from the fourth region of the irradiation section is within a range larger than the predetermined range; and a controller configured to control ejecting of the liquid from the nozzle column and irradiation of the dots in a first print mode and a second print mode, the second print mode creating an image quality lower than that of an image quality of the first print mode, wherein at a time of the first print mode, the controller is configured to form the dots using the first region of the nozzle column, and wherein at a time of the second print mode, the controller is configured to form the dots using the first region and the second region of the nozzle column wherein the irradiation section has a plurality of LEDs arranged in the predetermined direction as a light source of the light, and wherein the controller is configured to change an input current into the plurality of LEDs according to a position of each LED in the predetermined direction.

2. The liquid ejecting apparatus according to claim 1, wherein with respect to a first LED of the plurality of LEDs and a second LED positioned further to an end side thereof than the first LED in the predetermined direction, the controller allows the input current into the second LED to be larger than that into the first LED.

3. The liquid ejecting apparatus according to claim 1, wherein a distance between adjacent LEDs in the predetermined direction are different according to the position of the adjacent LEDs in the predetermined direction.

4. The liquid ejecting apparatus according to claim 1, wherein a length of the irradiation section in the predetermined direction is longer than that of the nozzle column in the predetermined direction.

5. A liquid ejecting apparatus comprising:

a nozzle column in which a plurality of nozzles configured to eject a liquid cured by receiving an irradiation of light is arranged in a predetermined direction parallel to a transportation direction of a medium, the nozzle column including a first region having a plurality of the plurality of nozzles and a second region having another plurality of the plurality of nozzles that incorporates the first region;

an irradiation section disposed along the predetermined direction corresponding to the nozzle column and configured to irradiate the light to dots formed on the medium by the nozzle column, the irradiation section including a third region corresponding to the first region and a fourth region corresponding to the second region, where a variation in a quantity of the light irradiated from the third region of the irradiation section is within a predetermined range and where a variation in a quantity of the light irradiated from the fourth region of the irradiation section is within a range larger than the predetermined range; and a controller configured to control ejecting of the liquid from the nozzle column, wherein the controller changes a nozzle region used in the nozzle column according to an irradiance distribution of the light, which is set in advance, of the irradiation section in the predetermined direction, and a print quality designated by a user.

6. A liquid ejecting method of a liquid ejecting apparatus that includes: a nozzle column in which a plurality of nozzles are configured to eject a liquid cured by receiving an irradiation of light is arranged in a predetermined direction parallel to a transportation direction of a medium, the nozzle column including a first region having a plurality of the plurality of nozzles and a second region having another plurality of the plurality of nozzles that incorporates the first region, and an irradiation section that is disposed along the predetermined direction corresponding to the nozzle column and configured to irradiate the light to dots formed on an medium by the nozzle column, the irradiation section including a third region corresponding to the first region and a fourth region corresponding to the second region, where a variation in a quantity of the light irradiated from the third region of the irradiation section is within a predetermined range and where a variation in a quantity of the light irradiated from the fourth region of the irradiation section is within a range larger than the predetermined range, the method comprising:

printing in a first print mode in which a plurality of dots are formed by ejecting the liquid from a first region of the nozzle column;

irradiating each dot that is formed with the light from the third region of the irradiation section, the irradiation section having plurality of LEDs arranged in the predetermined direction, where a variation in a light quantity is within the predetermined range and a controller configured to control liquid ejection from the first regions is configured to change an input current into the plurality of LEDs according to a position of each LED in the predetermined direction, printing in a second print mode that has an image quality lower than that of the first print mode and in which a plurality of dots is formed by ejecting the liquid from the second region having a number of dots more than that of the first region and incorporating the first region within the second region, and irradiating each dot that is formed from the second region with the light from the fourth region of the irradiation section, the irradiation section having the plurality of LEDs arranged in the predetermined direction, where variation in light quantity is within a range that is larger than the predetermined range and a controller configured to control liquid ejection from the first regions is configured to change an input current into the plurality of LEDs according to a position of each LED in the predetermined direction.

* * * * *